United States Patent [19]

Keller

[11] Patent Number: 4,565,224

[45] Date of Patent: Jan. 21, 1986

[54] APPARATUS FOR MONITORING WEFT THREAD IN A WEAVING MACHINE

[75] Inventor: Hans-Peter Keller, Wagen, Switzerland

[73] Assignee: Loepfe Brothers Limited, Wetzikon, Switzerland

[21] Appl. No.: 547,006

[22] Filed: Oct. 31, 1983

[30] Foreign Application Priority Data

Nov. 11, 1982 [CH] Switzerland ..... 6566/82

[51] Int. Cl.[4] ..... D03D 51/347

[52] U.S. Cl. ..... 139/370.2; 250/561

[58] Field of Search ..... 139/370.1, 370.2; 250/559, 561 R, 562

[56] References Cited

U.S. PATENT DOCUMENTS

| | | | |
|---|---|---|---|
| 3,824,401 | 7/1974 | Suzuki | 250/561 |
| 3,853,408 | 12/1974 | Kaalverink | 139/370.2 |
| 3,880,198 | 4/1975 | Vermeulen | 139/370.2 |
| 4,023,599 | 5/1977 | Zeleny | 139/370.2 |
| 4,150,699 | 4/1979 | Suekane | 250/561 |
| 4,188,981 | 2/1980 | Suekane | 250/561 |
| 4,362,190 | 12/1982 | Arakawa | 139/370.2 |

FOREIGN PATENT DOCUMENTS

| | | |
|---|---|---|
| 295430 | 1/1972 | Austria . |
| 0036314 | 3/1984 | European Pat. Off. . |
| 2204529 | 7/1973 | Fed. Rep. of Germany . |
| 2517471 | 10/1975 | Fed. Rep. of Germany . |
| 2451533 | 5/1976 | Fed. Rep. of Germany . |
| 2949765 | 6/1980 | Fed. Rep. of Germany . |
| 3140561 | 7/1982 | Fed. Rep. of Germany . |
| 2323651 | 5/1984 | Fed. Rep. of Germany . |
| 630126 | 5/1982 | Switzerland . |

*Primary Examiner*—Henry S. Jaudon
*Assistant Examiner*—S. Shongut
*Attorney, Agent, or Firm*—Werner W. Kleeman

[57] ABSTRACT

The weft thread monitoring apparatus contains a detecting circuit incorporating the functions of a thread recognition circuit and a control circuit for controlling the intensity of a thread sensing or scanning beam which is affected by extraneous effects like outside light, the presence of fluff and other influences. A monitoring and controlling circuit defines monitoring and control intervals to differentiate between thread signals which are respectively correctly and incorrectly related to the operating cycle of the weaving machine and to possibly cut off the weaving machine. A sensing head can be simply mounted and dismantled at any desired location at the reed of the weaving machine so that different widths of the woven material or fabric can be manufactured using the same reed and the weft thread can be monitored. By periodic indication of the thread signal the correct run or operation of the weaving machine also can be monitored. The thread signal indication is conceived such that malfunctions can be recognized from such indication.

30 Claims, 14 Drawing Figures

APPARATUS FOR MONITORING WEFT THREAD IN A WEAVING MACHINE

BACKGROUND OF THE INVENTION

The present invention relates to a new and improved apparatus for monitoring the weft thread in a weaving machine or the like.

In its more specific aspects the invention relates to a new and improved apparatus for monitoring the weft thread in a weaving machine, especially in a pneumatically operated weaving machine, which includes a sensing or scanning head comprising a transmitter and a receiver and sensing the weft thread. The monitoring apparatus further includes a signal processing and evaluating circuit connected to the sensing head.

An apparatus of this kind as known, for example, from German Patent Publication No. 2,513,356 comprises a transmitter section including at least one source of radiation and a receiving section including an even number of radiation detectors. The radiation sources and the radiation detectors are arranged at the internal circumference of a ring through which passes an insertion medium. Each radiation detector receives the radiation emanating from only one radiation source. The transmitter and the receiver are connected to a differential amplifier and a processing and evaluating device for the signals which are formed by the differential amplifier during a monitoring time interval, and such transmitter and receiver are also connected to switching means for cutting off the weaving machine. A comparator circuit in the processing and evaluating device is periodically placed into an operationally preparatory state by a switching device for predetermined monitoring intervals. The comparator circuit compares the signals with a reference or set value.

In another state-of-the-art apparatus as known, for example, from German Patent Publication No. 2,105,559, a ring-shaped weft-thread conveying fork is provided at each end thereof with a photoelectric transmitter and receiver which furnish a signal when the weft thread passes therethrough after the same has been inserted and beaten-up at the existent woven material, and which also furnish signals in the event that the weft thread is absent.

A known weft-thread monitoring device in a pneumatic weaving machine including a transport channel formed integrally with the reed comprises a transmitter and a receiver at the end of the reed on the catch side thereof. In case of different weaving widths different reeds of varying and corresponding widths have to be employed in order that there can be used the weft-thread monitoring apparatus.

In a further known weft-thread monitor there is required in the signal processing and evaluating means or circuit a sensitivity adjustment which has to be manually performed a number of times per day, depending upon the degree of contamination or soiling, so that the weft thread may be detected by a sensing beam of rays extending between an oscillator-supplied transmitter and a receiver. A selective amplifier, a rectifier, and a smoothing member are series connected to each other and to the receiver; to the smoothing member there is connected a comparator for comparison of the signal with a reference voltage supplied by a potentiometer, and a light-emitting diode is connected such as to indicate a weft thread which has been detected by the sensing beam of rays. In such an arrangement the weaving machine and the adjustment thereof must be continuously manually monitored.

SUMMARY OF THE INVENTION

Therefore, with the foregoing in mind, it is a primary object of the present invention to provide a new and improved apparatus for monitoring the weft thread in a weaving machine, which monitoring apparatus can be simply mounted to and dismantled from the reed at different locations in correspondence to the width of the woven material without requiring any modifications, so that different width materials can be woven using one reed including the weft thread monitoring apparatus.

Another important object of the present invention is directed to the provision of a new and improved construction of an apparatus for monitoring the weft thread in a weaving machine which permits automatic adaptation of the intensity of the sensing beam to extraneous effects so as to obtain reliable thread recognition or detection in case of, for example, unavoidable contamination of the equipment.

Still a further significant object of the present invention is directed to a new and improved apparatus for monitoring the weft thread in a weaving machine which can be effectively used throughout a range of operating speeds of the weaving machine.

Another important object of the present invention is directed to a new and improved construction of an apparatus for monitoring the weft thread in a weaving machine by means of which the orderly function of the weaving machine can be effectively monitored and controlled.

Now in order to implement these and still further objects of the invention, which will become more readily apparent as the description proceeds, the monitoring apparatus of the present development is manifested by the features that, the processing and evaluating circuit comprises a detecting circuit for deriving a thread signal which has been rendered independent of extraneous effects and a monitoring and control circuit connected to the detecting circuit for linking the thread signal to operating cycle intervals of the weaving machine in order to monitor and control the function thereof.

According to an advantageous further development of the monitoring apparatus according to the invention, the sensing head is structured so as to be releasably mounted at any desired location of a reed of the weaving machine, and at least sections or portions of the path of the sensing beam of rays emitted from the transmitter to the receiver extend between lamellae of the reed along the depth extension thereof and intersect the path of the inserted weft thread.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
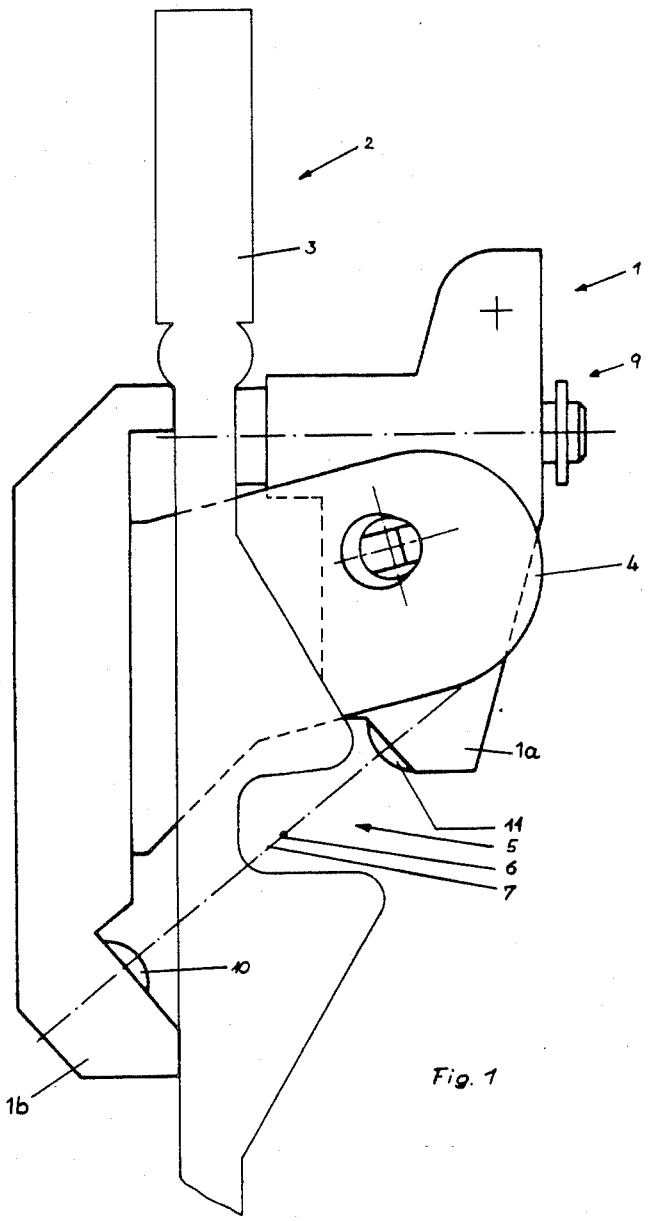
FIG. 1 is a side view of the sensing or scanning head in a first embodiment of weft-thread monitoring apparatus constructed according to the present invention.
Figure 2:
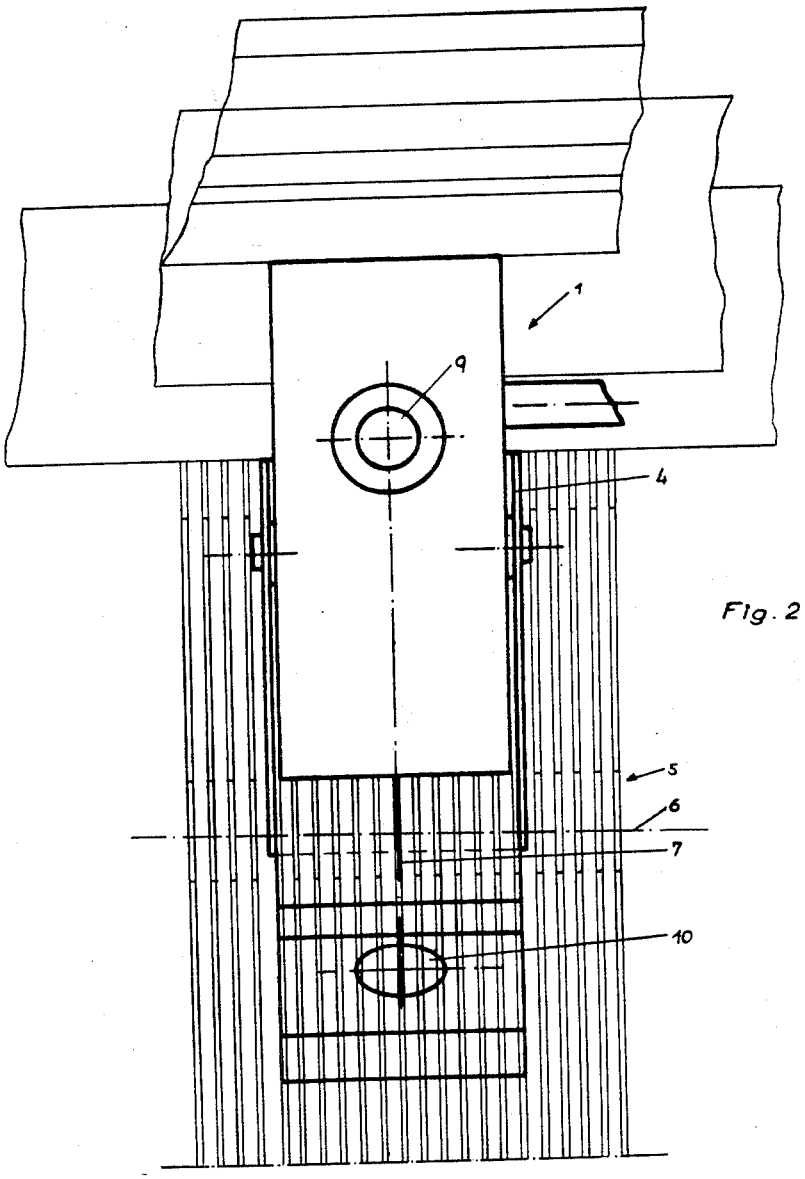
FIG. 2 is a front view of the sensing head shown in FIG. 1.

Describing now the drawings, it is to be understood that only enough of the construction of the weft-thread monitoring apparatus has been shown as needed for those skilled in the art to readily understand the underlying principles and concepts of the present development, while simplifying the showing of the drawings. Turning attention now specifically to the first embodiment of monitoring apparatus illustrated in FIGS. 1 to 5, the sensing or scanning head 1 of the weft-thread monitoring apparatus has arms or arm members 4 which extend between two respective adjacent lamellae 3 of a reed 2 when the sensing or scanning head 1 is mounted at the reed 2. In this arrangement the component or part 1*a* of the sensing head 1 containing the receiver 11 is releasably fixed on one side of the reed 2 to the arms 4 of the component or part 1*b* supporting the transmitter 10. Preferably the receiver 11 is placed on the one side of the transport or conveying channel 5 for the weft thread 6 and which transport channel 5 is integrated with the reed 2. The transmitter-carrying component 1*b* is arranged on the other side of the reed 2 facing away from the transport channel 5. In the present arrangement the transmitter 10 and the receiver 11 are placed in substantially rectilinear opposition to each other. The axis defined by the transmitter 10 and by the receiver 11 forms the axis of a sensing beam of rays or sensing beam 7. When assembling or mounting the sensing or scanning head 1 the axis of the sensing beam 7 is adjusted such that it generally intersects the flight or insertion path of the weft thread 6.

The transmitter 10 and the receiver 11 are connected via a connector 9 or equivalent structure to an electronic signal processing and evaluating circuit 15. This evaluation or evaluation circuit 15 comprises a detecting or detection circuit 16 and a monitoring and control circuit 17 operatively connected therewith. The detecting circuit 16 controls the intensity of the sensing or scanning beam of rays 7 as a function of extraneous effects such as contamination or soiling, outside light, aging and so forth, in order to obtain a system-dependent and essentially constant intensity of the sensing or scanning beam of rays 7, and thus, reliable thread recognition or detection signals. Additionally, the detecting or detection circuit 16 supplies the thread recognition signals and suppresses spurious signals which are caused, for example, by fluff or other thread parts or by outside or ambient light. The monitoring and control or controlling circuit 17 differentiates between the thread signals, which correctly arrive in respect of the operating cycle of the weaving machine or loom WM, and signals caused by malfunction and controls the weaving machine WM in correspondence thereto or cuts-off the same. The latter occurs particularly in the case of thread or yarn rupture.

The detecting circuit 16 comprises a control or regulating circuit 20 and a thread recognition circuit 40 which is operatively connected thereto. The detecting circuit 16 is connected to the monitoring and control circuit 17 of the signal processing and evaluating circuit 15. The detecting circuit 16 also contains electric components or sections 21 and 26 associated with transmitter 10 and the receiver 11, respectively; for abbreviation purposes, these components are also conveniently termed transmitter 21 and receiver 26 in the following description. In the detecting circuit 16 the transmitter 21 is connected to the output side 22*a* of a controllable current source 22, the input side 22*b* of which is connected to a suitable controllable control member 23 which, for example, may comprise a conventional sample-and-hold member or circuit composed of a switch and a capacitor. The controllable control member 23 comprises two inputs 30, 31 and an output 32. The first input 30 of the controllable control member 23 is connected to the output 14 of a comparator 24 to be described more fully hereinafter, and the second input 31 of the controllable control member 23 is connected to the monitoring and control circuit 17 also to be described more fully hereinafter. The output 32 is connected to the input side 22*b* of the controllable current source 22. The comparator 24 of the detecting circuit 20 has two inputs 12 and 13. The first input 12 is connected to the receiver 26 and the second input 13 is connected to the output side 25*a* of a reference voltage generator 25 which supplies an adjustable reference voltage to the comparator 24.

The receiver 26 is furthermore connected to the thread recognition circuit 40 and specifically to the input 36 of a first comparator 41 thereof. Series connected thereto is an integrator 42 and a second comparator 43 having an output 37. By appropriately selecting the threshold values of the first and second comparators 41 and 43 as well as the rise and fall times of the integrator 42, true thread signals can be reliably differentiated from spurious thread signals. The output 37 of the second comparator 43 is connected to the monitoring and control circuit 17.

This monitoring and control circuit 17 comprises a pulse generator or transmitter 50, for example a trigger, which is controlled by the weaving machine WM. The pulse generator 50 supplies a starting pulse of a control interval at a predetermined moment of time within the operating cycle of the weaving machine WM, for example, at an angle of 220° and, at a subsequent moment of time, for example at an angle of 310°, a stop pulse for limiting the control interval. The control interval may have the same length as a monitoring interval for establishing the correct insertion of the weft thread 6. However, the monitoring interval may also form a true subinterval within the control interval. Only when the thread signal occurs within the monitoring interval, not only has the weft thread been inserted or introduced, but also has been inserted at the correct moment of time. On its output side 50*a* the pulse generator 50 is connected to a clock pulse generator 60. The clock pulse generator 60 is feed-back connected to define the start of the monitoring interval.

Figure 3:
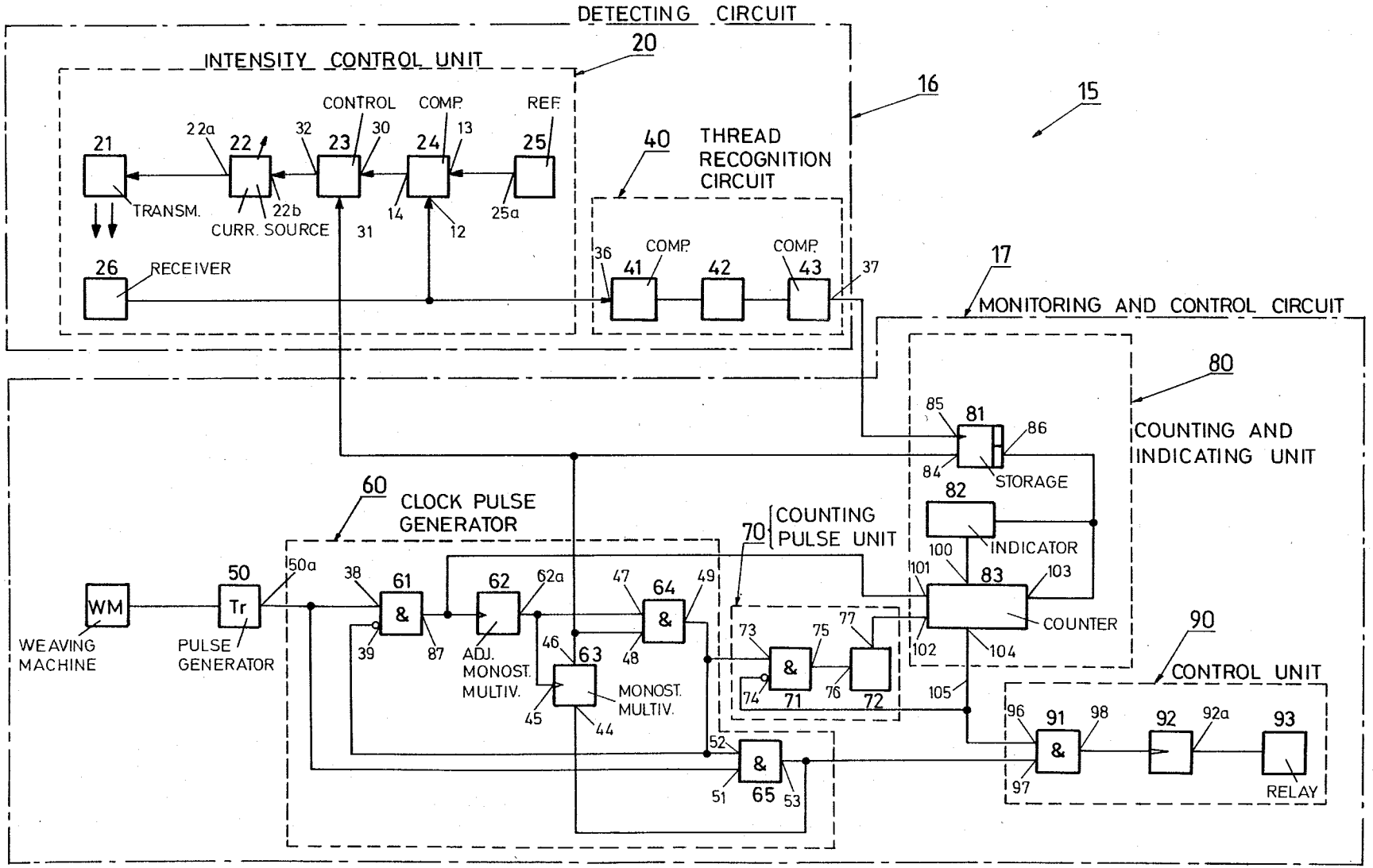
FIG. 3 is a schematic block circuit diagram of a signal processing and evaluating circuit of the monitoring apparatus shown in FIG. 1.

The clock pulse generator 60, as shown in FIG. 3, comprises a first AND-gate 61 having two inputs 38, 39 and an output 87 and further comprises a third AND-gate 65 having two inputs 51, 52 and an output 53. The first inputs 38 and 51 of the first and third AND-gates 61 and 65, respectively, are connected to the pulse generator 50. The output 87 of the first AND-gate 61 is connected, firstly, to an adjustable monostable or one-shot multivibrator 62 which acts as a timing element and, secondly, to the second input 101 of a counter 83 in a counting and indicating unit or circuit 80 which also forms part of the monitoring and control circuit 17.

In the clock pulse generator 60 there is further provided a first monostable or one-shot multivibrator 63 having two inputs 44, 45 and an output 46. The first input 44 or R-input is connected to the output 53 of the third AND-gate 65 and the second input 45 is connected to the output side 62*a* of the adjustable monostable multivibrator 62. The output 46 of the first monostable multivibrator 63 is firstly connected to the second input 31 of the controllable control member 23 in the detecting circuit 20 and, secondly, to the second input 48 of a second AND-gate 64, the first input 47 of which is connected to the output side 62*a* of the adjustable monostable multivibrator 62 and the output 49 of which is connected to the second input 52 of the third AND-gate 65. The output 49 of the second AND-gate 64 is also connected to the second input 39 of the first AND-gate 61 and to a counting pulse unit or circuit 70.

The counting pulse unit 70 which also forms part of the monitoring and control circuit 17 comprises a fourth AND-gate 71 having two inputs 73, 74 and an output 75. The first input 73 of the fourth AND-gate 71 is connected to the output 49 of the second AND-gate 64 in the clock pulse generator 60 and the second input 74 of the fourth AND-gate 71 is connected to a counting and indicating unit 80 as well as to a control unit 90, to be described more fully hereinbelow. The output 75 of the fourth AND-gate 71 is connected to the input of a counting pulse generator 72 having an output 77 which is connected to a third input 102 of the counter 83 in the counting and indicating unit or circuit 80. The counting pulse generator 72 may particularly comprise an astable multivibrator.

The counting and indicating unit or circuit 80 comprises a storage member 81, an indicator 82 and a five-stage forward counter 83. The storage member 81 has a first input 84 which is connected to the output 46 of the first monostable or one-shot multivibrator 63 in the clock pulse generator 60 and a second input 85 which is connected to the output 37 of the second comparator 43 in the thread recognition circuit 40 of the detecting circuit 16. The output 86 of the storage member 81 is connected to the indicator 82 and to a fourth input 103 of the counter 83. The first input 100 of the counter 83 is connected to the indicator 82, the second input 101 is connected to the output 87 of the first AND-gate 61 in the clock pulse generator 60, the third input 102 of the counter 83 is connected to the output 77 of the counting pulse generator 72 in the counting pulse unit or circuit 70, and the output 104 of the counter 83 is connected to the output or output side 105 of the counting and indicating unit 80. This output 105 is firstly connected to the second input 74 of the fourth AND-gate 71 in the counting pulse unit 70 and, secondly, to the control unit 90 which also forms part of the monitoring and control circuit 17. The control unit or circuit 90 comprises a fifth AND-gate 91 having two inputs 96, 97 and an output 98. The first input 96 is connected to the output 105 of the counting and indicating unit 80, while the second input 97 is connected to the output 53 of the third AND-gate 65 in the clock pulse generator 60. The output 98 is connected to a second monostable or one-shot multivibrator 92 and the output 92*a* thereof is connected to a relay 93 of the weaving machine or loom WM.

When the sensing or scanning beam of rays or sensing beam 7 is interrupted by a thread 6, the detecting circuit 16 supplies a signal to the monitoring and control circuit 17 which establishes whether the thread signal has been generated at the correct moment of time with respect to the operating cycle of the weaving machine or loom WM. When this is not the case, a signal is generated for cutting off the weaving machine WM which is then supplied to the shutdown relay 93 thereof.

The control circuit 20 in the detecting circuit 16 automatically controls or regulates the intensity of the sensing or scanning beam of rays 7. This control or regulation is performed when no signal is present at the second input 31 of the controllable control member 23. Under these conditions the switch contained in the controllable control member 23 is closed and the capacitor therein is charged. The receiver 26 supplies a d.c.-voltage which is compared in the comparator 24 with the reference or set voltage generated by the reference or set voltage generator 25. During normal operation the difference between the two voltages is equal to zero. If the difference is not equal to zero, then the current source 22 is controlled and the intensity of the sensing or scanning beam of rays 7 is varied until there is again set a voltage difference amounting to zero. This control or regulation operation occurs within a fraction of the operating cycle of the weaving machine or loom WM, which cycle, for example, is governed by the interval between the insertion of the weft thread and that of the next following weft thread. For the time period during which the control operation is carried out the weaving machine WM assumes an operational range or state which does not require control of the insertion of the weft thread. The time interval for the intensity control and the control interval, and thus, also the monitoring interval, do not overlap. However, it would also be possible to carry out the intensity control operation more slowly than for a fraction of the operating cycle of the weaving machine WM. Still, a rapid intensity control operation has proven to be more advantageous, i.e. an intensity control interval which is smaller than the operating cycle of the weaving machine.

A part of the operating cycle of the weaving machine or loom WM is defined as a monitoring interval (hold operation) for recognizing or detecting the weft thread 6. Within this monitoring interval there is established, firstly, whether a thread signal occurs and, secondly, whether it occurs at the correct moment of time.

Figure 4:
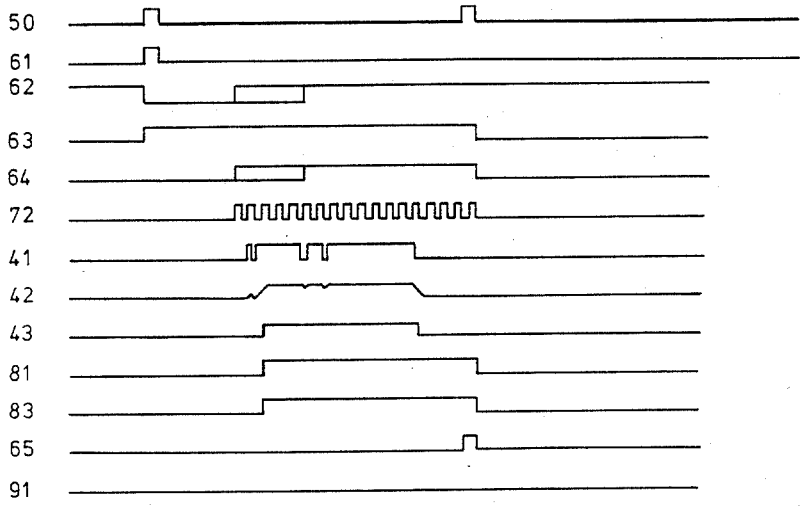
FIG. 4 is a pulse diagram showing the pulses which occur in the presence of the weft thread at different locations of the signal processing and evaluating circuit shown in FIG. 3.
Figure 5:
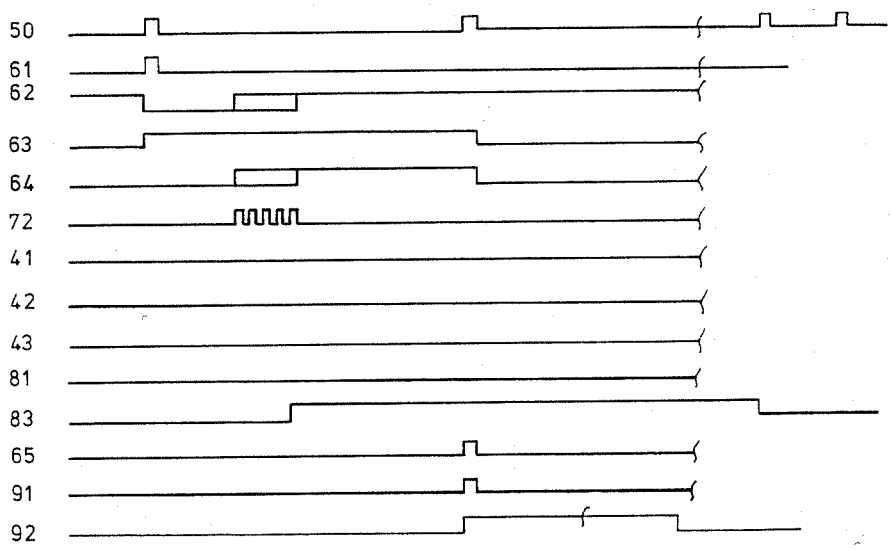
FIG. 5 is a pulse diagram showing the pulses which occur in the absence of the weft thread in the signal processing and evaluating circuit shown in FIG. 3.

The operation of the weft-thread monitoring apparatus described hereinafter will now be explained in detail with reference to FIGS. 4 and 5, wherein FIG. 4 relates to the case of a present weft thread and FIG. 5 to the case of an absent weft thread.

The pulse generator or trigger 50 which is controlled by the weaving machine or loom WM supplies a starting pulse and at some later moment of time a stop pulse, for example, at loom shaft angles of 220° and 310°, respectively, during the operating cycle. The control interval is established by these pulses. By means of the starting pulse, on the one hand, the intensity control of the sensing beam of rays 7 is terminated in the intensity control circuit 20. This is effected by opening the switch contained in the controllable control member 23 i.e. the sample-and-hold circuit. Since the capacitor therein is charged, such capacitor controls the controllable current source 22 which supplies the current for the sensing or scanning beam of rays 7 in accordance with the last intensity value which was present prior to the end of the intensity control interval.

The monitoring interval, for example, is constituted by a sub-interval of the control interval and is established by the feed-back connected clock pulse generator 60 in combination with the counting and indicating unit or circuit 80. When a weft thread 6 intersects the sensing or scanning beam of rays 7 within the monitoring interval, then a voltage surge or jump occurs in the receiver 26 and such arrives at the first comparator 41 of the thread recognition circuit 40. When the pulse possesses a sufficient length or duration then the voltage in the integrator 42 rises within the contemplated rise time, which is matched to the actual conditions, to a value which corresponds to the threshold value of the series connected second comparator 43. A thread pulse then is supplied to the storage member 81 in the counting and indicating unit 80.

The starting pulse of the pulse generator 50, on the other hand, places the monitoring and control circuit 17 into a state, corresponding to the monitoring interval, in which a thread signal from the receiver 26 can be accepted. Accordingly, the adjustable monostable or one-shot multivibrator 62 and the first monostable or one-shot multivibrator 63 are set to a first state. The moment of time at which the adjustable monostable multivibrator 62 is reset is adjustable, and thus, there is triggered the course or run of counting pulses at the counting pulse generator 72 in the counting pulse unit or circuit 70. The sequence of counting pulses which is thus produced is applied to the five-stage forward counter 83 of the counting and indicating unit 80. The counter 83 stops upon arrival of a thread pulse from the detecting circuit 16 via the storage member 81, when such thread pulse occurs within the monitoring interval. If no thread pulse arrives, then the counter 83 stops at a predetermined counting stage. Also, the counter 83 may furnish a cut-off pulse to the counting pulse generator 72 which may be constituted by an astable multivibrator. The indicator 82 connected to the five-stage forward counter 83 comprises a light-emitting diode for each counting pulse or each group of counting pulses. Only that light-emitting diode lights-up which is associated with the counting pulse which coincides with the thread signal. For example, a green light-emitting diode lights-up when the thread signal occurs within a predetermined or reference range and no control pulse is supplied to the relay 93 for cutting-off the weaving machine WM. However, if the thread signal occurs before or after the predetermined or reference range, for example, a red light-emitting diode lights-up and a cut-off pulse is supplied. Depending upon the construction of the indicator 82 the same also may be employed for error indication of a defective run or operation of the weaving machine WM, because the position of the thread signal enables such interpretations. Specifically, the signal processing and evaluating circuit 15 can be adjusted or set by means of the adjustable monostable or one-shot multivibrator 62 such that always the same light-emitting diode lights-up when the thread signal occurs at the correct moment of time. When the thread signal does not occur at the correct moment of time, then the corresponding indication can be fixedly maintained which simplifies the error detection.

The thread recognition circuit 40 in the detecting circuit 16 differentiates between fluff or the like originating from the threads and the weft thread 6. A fluff particle will only produce a short pulse. In the case of a short pulse the integrator 42, due to its rise time, cannot reach a value corresponding to the threshold value of the series-connected second comparator 43. The threshold value is selected and adjusted in relation to a true thread pulse. Thus, a fluff-generated pulse can be unequivocally distinguished from a thread pulse.

Thread vibration is also filtered out by the thread recognition circuit 40. When the weft thread 6 leaves the range of the sensing or scanning beam of rays 7 for a short period of time, this short period of time will be insufficient for the integrator 42 to lower the voltage value below the threshold value of the second comparator 43. Therefore, the integrator 42 does not change its output signal. The thread pulse remains at the storage member 81.

The transmitter 10 may be arranged in the sensing or scanning head 1 such that the transmitter is located on the rear side of the loom reed 2 and the receiver 11 on the front side thereof. Due to the geometric conditions in a reed with integrated weft-thread channel or passage 5 such a transmitter and receiver arrangement can be advantageous because, due to the shorter distance between the weft thread 6 and the receiver 11, there is obtained a larger scanning or sensing field. Such larger scanning field may compensate for the higher contrast obtained at larger distances.

Figures 6, 8A, 8B:
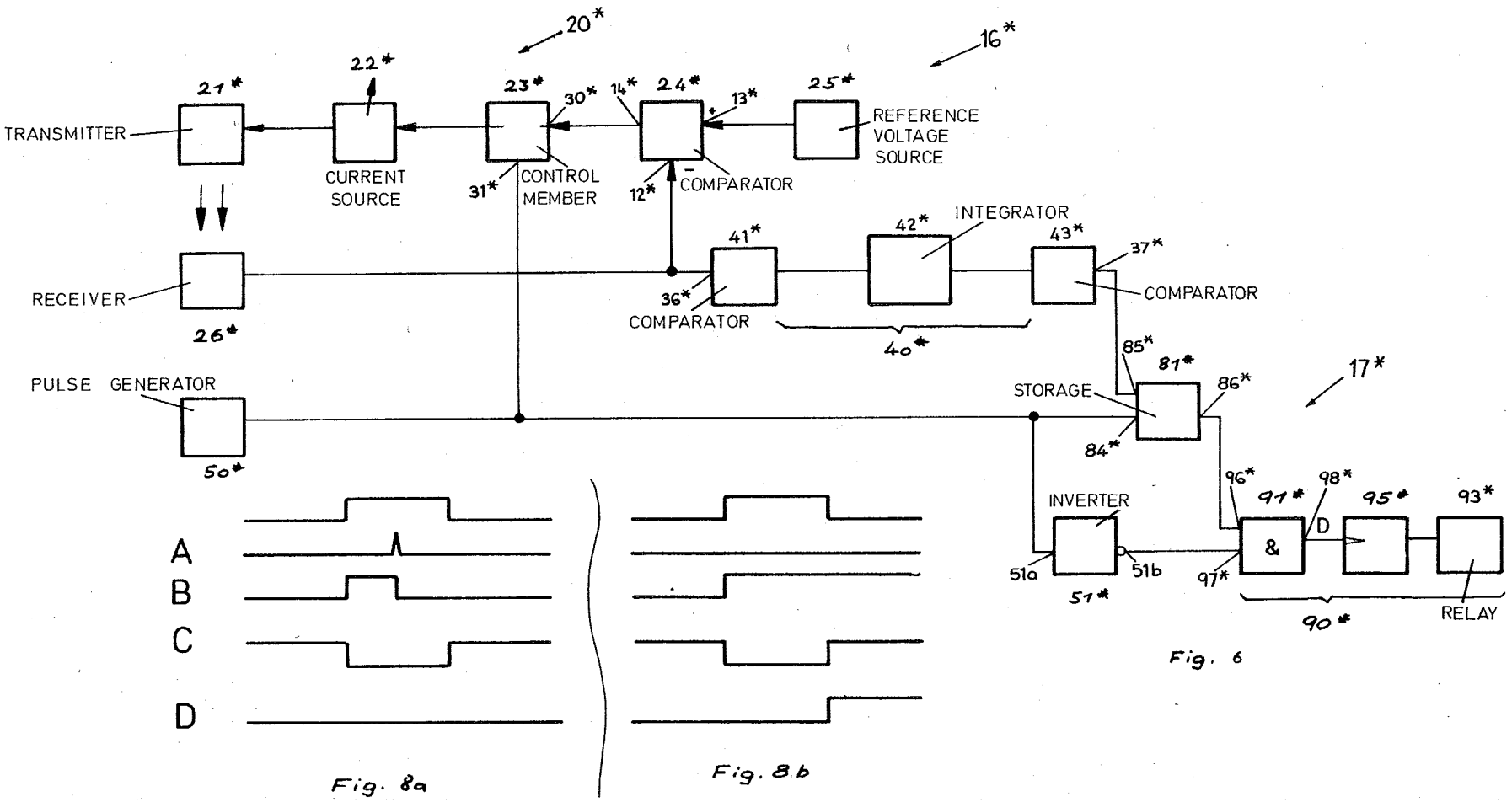
FIG. 6 is a schematic block circuit diagram of a signal processing and evaluating circuit in a second embodiment of the weft-thread monitoring apparatus according to the invention.
FIGS. 8*a* and 8*b* are pulse diagrams showing the pulses which occur at different locations of the signal processing and evaluating circuit shown in FIG. 6 during the operating or run interval and during the stop interval of the weaving machine, respectively.

A second embodiment of the weft-thread monitoring apparatus according to the invention is illustrated in the schematic block circuit diagram of FIG. 6. In the monitoring and control circuit 17* thereof there is provided a pulse generator or trigger 50*, an inverter 51*, the input side **51*a* of which is connected to the pulse generator 50*, a storage member 81*, a first input 84* of which is connected to the pulse generator 50* and a second input 85* of which is connected to the output 37* of the second comparator 43* in the thread signal recognition circuit 40*. There is also provided a controllable control member 23* comprising a sample-and-hold member or circuit, a first input 30* of which is connected to an output 14* of a comparator 24* and a second input 31* of which is connected to the pulse generator 50*. A first input 12* of the comparator 24* is connected to the receiver 26* and a second input 13* to a reference or set voltage generator 25* The other components like the transmitter 21* and the current source 22* correspond to those described hereinbefore with reference to FIG. 3. At its output side 51*b* the inverter 51* is connected to a second input 97* of an AND-gate 91*, the first input 96* of which is connected to the output 86* of the storage member 81*. The AND-gate 91* is connected in series with a dynamic monostable or one-shot multivibrator 95* and such, in turn, again is connected to a relay 93* for controlling the weaving machine or loom WM and the last-mentioned components together form a control unit 90*. The operation of the weft-thread monitoring apparatus is just described in FIGS. 8*a* and 8*b*** portraying the respective case of a present weft thread and an absent weft thread.

Figures 7, 9:
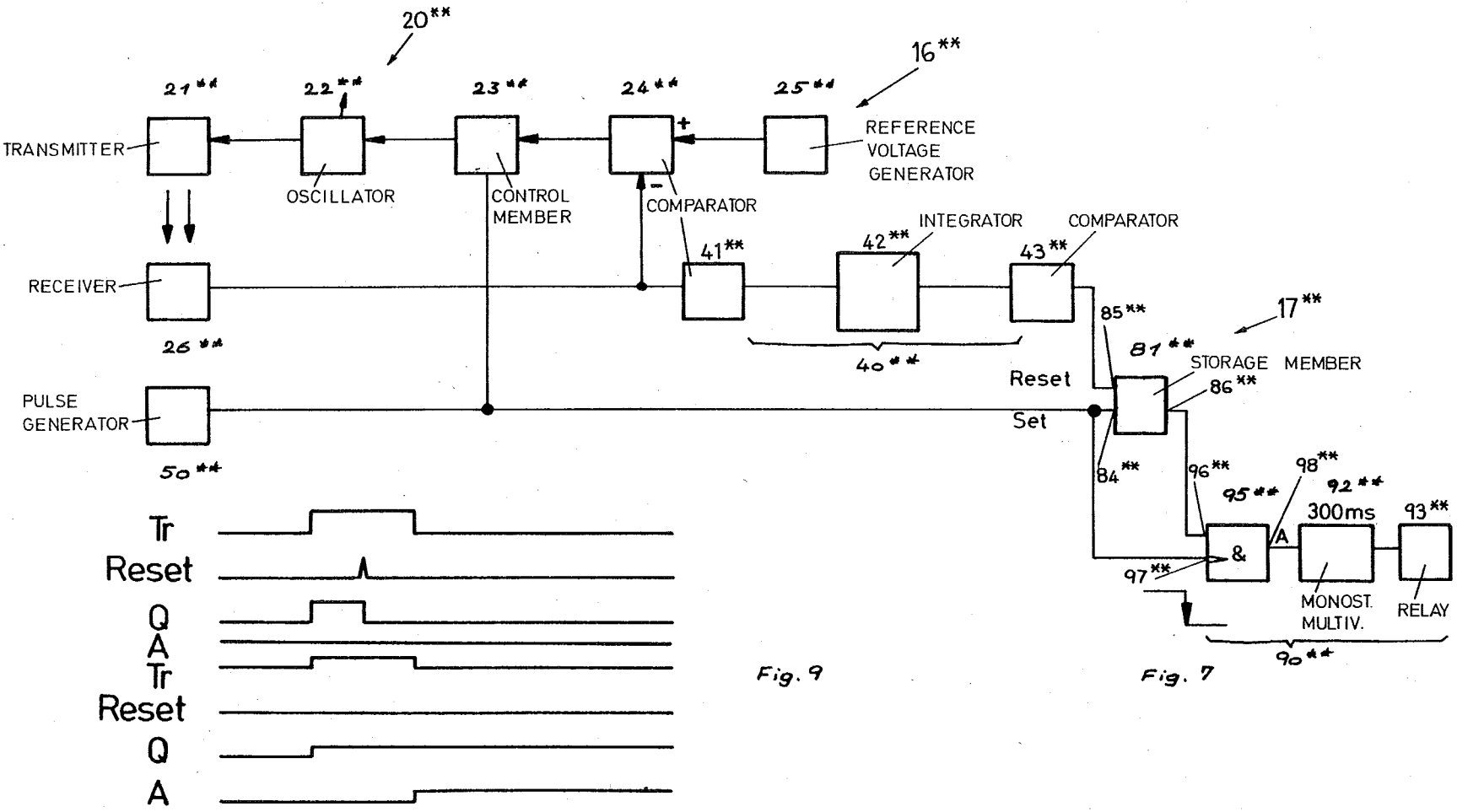
FIG. 7 is a schematic block circuit diagram of a signal processing and evaluating circuit in a third embodiment of the weft-thread monitoring apparatus according to the invention.
FIG. 9 is a pulse diagram showing the pulses which occur at different locations of the signal processing and evaluating circuit shown in FIG. 7.

According to a third embodiment of the inventive weft-thread monitoring apparatus, the operation of which is briefly illustrated in FIG. 9, the signal processing and evaluating circuit, as shown in FIG. 7, comprises a control unit or circuit 90 which is directly controlled by a pulse generator 50** and a storage member 81**. The storage member 81** has a first input 84** connected to the pulse generator 50**, a second input 85** connected to the output side of the thread recognition circuit 40** and an output 86**. The control unit 90** contains a dynamic AND-gate 95**, the first input 96** of which is connected to the output 86** of the storage member 81** and the second input 97** of which is connected to the pulse generator 50**. The output 98** of the dynamic AND-gate 95** is connected to a second monostable or one-shot multivibrator 92** which, in turn, is connected to a relay 93** controlling the weaving machine or loom WM. The detecting circuit 16** includes the same components and operates in the same way as the detecting or detector circuit 16 described heretofore with reference to FIG. 3**.

Figure 10:
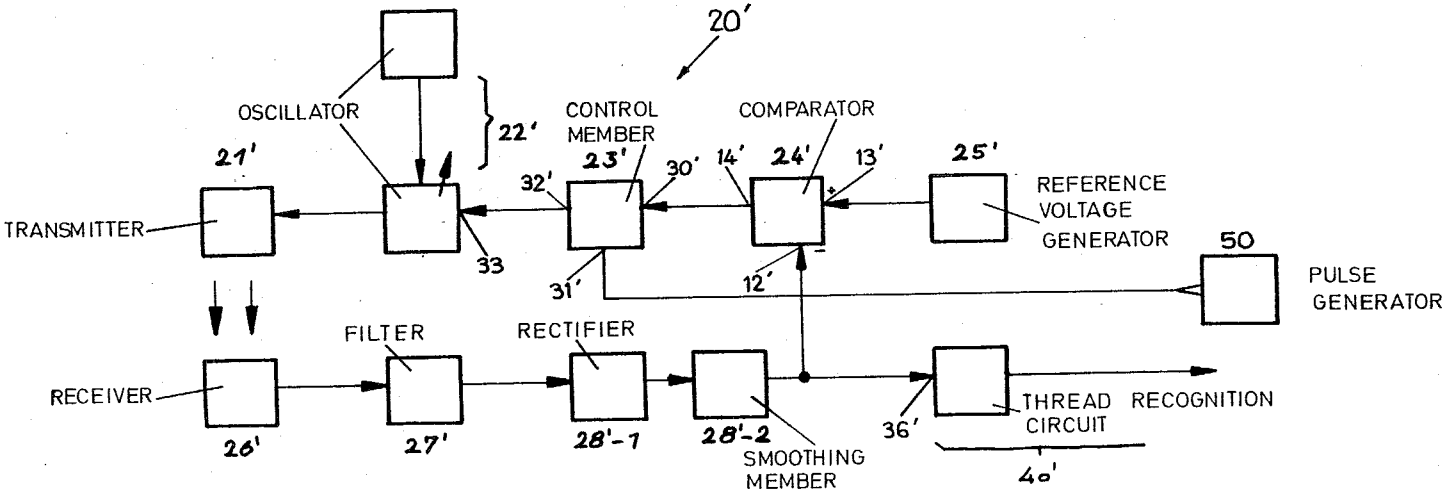
FIG. 10 is a schematic block circuit diagram of a control circuit in a detecting circuit according to a fourth embodiment of the weft-thread monitoring apparatus according to the invention.

In a fourth embodiment of the apparatus as shown in FIG. 10, the control or regulation circuit 20' comprises a transmitter 21' which is controlled by an amplitude-controlled oscillator 22'. The latter is controlled by a controllable control member 23' which, for instance, is constituted by a sample-and-hold member or circuit, and a first input 30' of which is connected to the output 14' of a comparator 24'. The second input 31' of the controllable control member 23' is connected to the pulse generator 50. The comparator 24' has a first input 12' connected to the receiver 26' via a selective filter 27', a rectifier 28'-1 and a smoothing member 28'-2, and a second input 13' connected to a reference or set voltage generator 25'. In the comparator 24' the signal received from the smoothing member 28'-2 is compared with the reference or set voltage generated by the reference voltage generator 25'. Comparable to the arrangement shown in FIG. 3 concerning the first embodiment of the inventive monitoring apparatus here too a similar thread recognition circuit 40' is connected to the output side of the smoothing member 28'-2. In this embodiment while the transmitter 21' produces a pulsating beam of rays, this embodiment still functions generally in the same manner as the first embodiment operating with non-alternating and a controlled light intensity. The monitoring and control circuit (here not shown) is connected to the output side of the thread recognition circuit 40' and can be constructed like any one of the circuits 17, 17* or 17** described hereinbefore.

Figure 11:
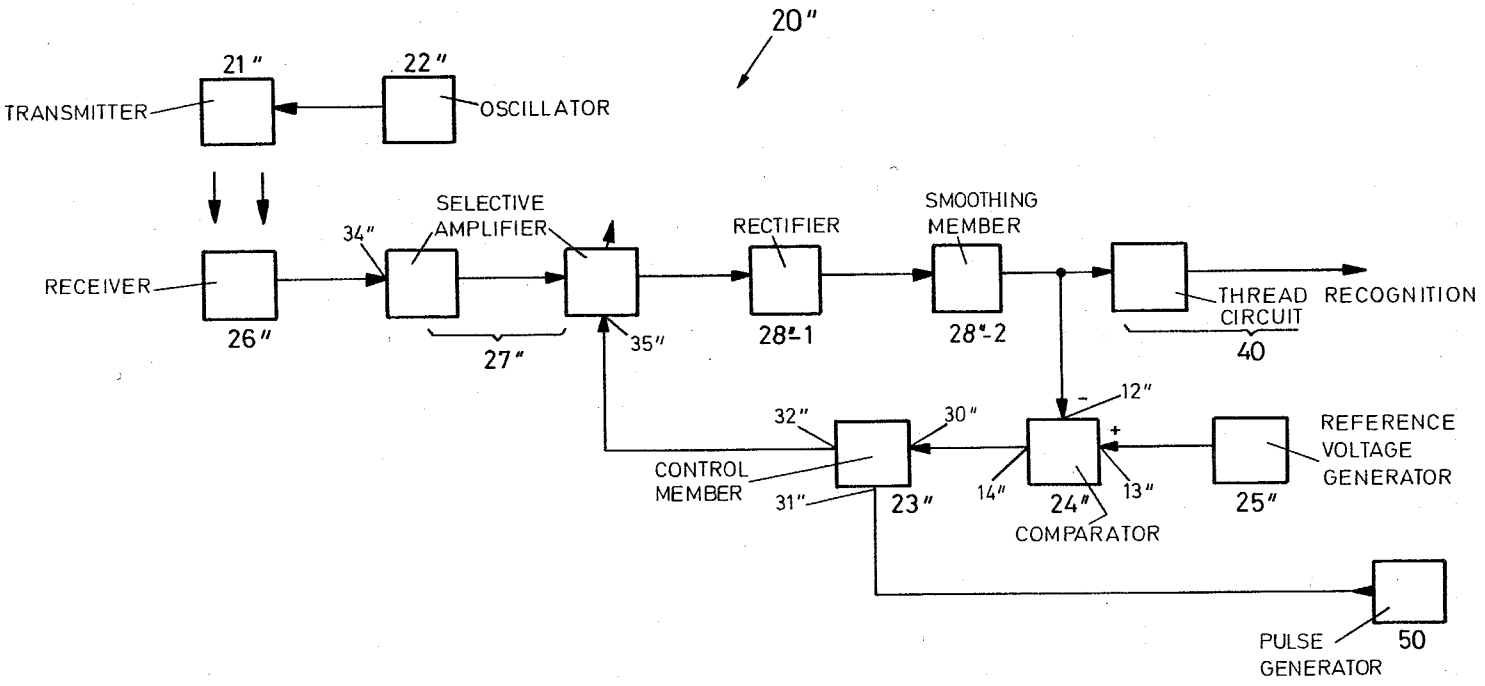
FIG. 11 is a schematic block circuit diagram of a control circuit in a detecting circuit according to a fifth embodiment of the weft-thread monitoring apparatus according to the invention.

A fifth embodiment of the apparatus according to the invention is illustrated in FIG. 11, which shows a different control or regulation circuit 20'' which comprises an oscillator 22'' connected to the transmitter 21''. The signal generated by the receiver 26'' arrives at a first input 12'' of a comparator 24'' via a selective amplifier 27'', a rectifier 28''-1 and a smoothing member 28''-2 to which there is also connected a thread recognition circuit 40''. At the comparator 24'' the signal is compared to the constant reference or set voltage which is generated by the reference or set voltage generator 25'' and supplied to a second input 13'' of the comparator 24''. The output 14'' of the comparator 24'' is connected to the first input 30'' of the controllable control member 23'', the second input 31'' of which is connected to the pulse generator 50. The output 32'' of the controllable control member 23'', which also may be constituted by a sample-and-hold member or circuit, is connected to a second input 35'' of the selective amplifier 27'', the first input 34'' of which is connected to the receiver 26''. When the switch contained in the controllable control member 23'' is closed, the signal is supplied to the selective amplifier 27'' and controls the same. When a non-zero difference is detected in the comparator 24'', the range at the selective amplifier 27'' is readjusted. The intensity control operation is terminated by the pulse generated by the pulse generator 50, and the selective amplifier 27'' is maintained at its last adjusted operating range. The monitoring and control circuit (not shown) is connected to the output of the thread recognition circuit 40'' and can be constructed like any one of the circuits 17, 17* or 17** as described hereinbefore.

Figure 12:
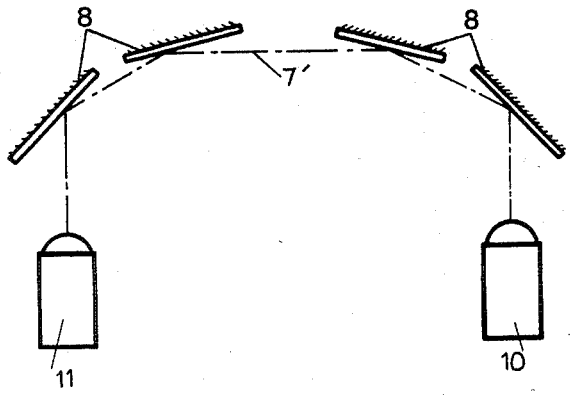
FIG. 12 is a schematic illustration depicting the path of the sensing beam of rays in a sixth embodiment of the weft-thread monitoring apparatus according to the invention.

In other arrangements like that shown in FIG. 12, the sensing or scanning beam of rays 7' extend along two or more straight lines which form the circumference or outline of a polygon. In the arrangement of FIG. 12 as well as that of FIG. 13 one or more mirrors 8 or other suitable reflectors are employed for deflecting the beam of rays. Such path of rays may be advantageous for a particularly compact construction of the sensing or scanning head 1 or for satisfying special spatial conditions at the reed 2.

Figure 13:
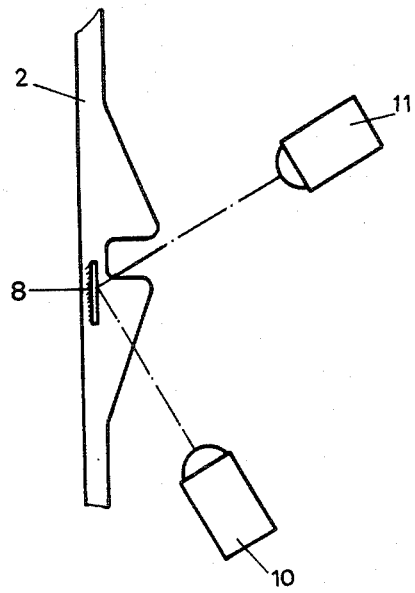
FIG. 13 is a schematic illustration depicting the path of the the sensing beam of rays in a seventh embodiment of the weft-thread monitoring apparatus according to the invention.

In the arrangements of FIGS. 12 and 13 the transmitter 10 and the receiver 11 are located on the same side of the reed 2 in contrast to, for instance, the arrangement of FIG. 1 where the transmitter 10 and the receiver 11 are arranged at opposite sides of the reed 2.

Furthermore, the sensing beam of rays emitted by the transmitter may be either totally or partially masked by the inserted weft thread.

According to further possible constructions of the inventive weft-thread monitoring apparatus, the signal processing and evaluating circuit comprises microprocessors which are designed to perform all of the switching functions of the circuit combinations described hereinbefore.

While there are shown and described present preferred embodiments of the invention, it is to be distinctly understood that the invention is not limited thereto, but may be otherwise variously embodied and practiced within the scope of the following claims. Accordingly,

I claim:

1. An apparatus for monitoring a weft thread in a weaving machine operated in operating cycles, comprising:

a sensing head for sensing a weft thread;

said sensing head comprising a transmitter and a single receiver operatively associated with said transmitter;

a signal processing said evaluating circuit operatively connected to said sensing head;

said signal processing and evaluating circuit comprising:

a detecting circuit for deriving a thread signal which is independent of extraneous effects; and a monitoring and control circuit operatively connected to said detecting circuit for linking said thread signal to operating cycles of the weaving machine in order to monitor and control the function thereof.

2. The apparatus as defined in claim 1, wherein:

the weaving machine contains a reed comprising lamellae having a predetermined depth extension and defining a weft-thread insertion path;

said sensing head being releasably mounted at any desired location on said reed;

said transmitter and said receiver of said sensing head defining a path of sensing rays extending therebetween; and at least sections of said path of sensing rays extending between said lamellae of said reed along said depth extension thereof and intersecting said weft-thread insertion path.

3. The apparatus as defined in claim 2, wherein:

said path of sensing rays extends substantially along a straight line.

4. The apparatus as defined in claim 2, wherein:

said transmitter and said receiver being arranged on a common side of the reed.

5. The apparatus as defined in claim 2, wherein:

said transmitter generates a sensing beam of rays which passes along said path of sensing rays; and said sensing beam of rays is totally masked by said weft thread.

6. The apparatus as defined in claim 2, wherein:

said transmitter generates a sensing beam of rays which passes along said path of sensing rays; and said sensing beam of rays is partially masked by said weft thread.

7. The apparatus as defined in claim 3, wherein:

said reed defines two sides thereof with respect to a weft thread conveying channel integrated with said reed;

said transmitter generating a sensing beam of rays and being arranged on one of said two sides of the reed; and said receiver being arranged on the other one of said two sides of the reed.

8. An apparatus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine in order to monitor and control the function thereof;

the weaving machine containing a reed comprising lamellae having a predetermined depth extension and defining a weft-thread insertion path;

said sensing head being releasably mounted at any desired location on said reed;

said transmitter and said receiver of said sensing head defining a path of sensing rays extending therebetween;

at least sections of said path of sensing rays extending between said lamellae of said reed along said depth extension thereof and intersecting said weft-thread insertion path; and said path of sensing rays extends substantially along the circumference of a polygon.

9. An apparatus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine in order to monitor and control the function thereof;

said transmitter generating a sensing beam of rays;

said detecting circuit comprising a control circuit for automatically controlling the intensity of said sensing beam of rays so as to be within a predetermined intensity range and unaffected by undesired extraneous effects; and said detecting circuit further comprising a thread recognition circuit for selecting said thread signal from spurious signals.

10. The apparatus as defined in claim 9, further including:

means operatively connected to the weaving machine and generating a pulse;

said control circuit comprising a controllable current source controlling said intensity of said sensing beam of rays during an intensity control interval which is terminated by said pulse; and said control circuit further comprising a controllable control member operatively connected to said controllable current source to hold the same at a condition corresponding to a final magnitude of said intensity prevailing at the end of said intensity control interval terminated by said pulse.

11. The apparatus as defined in claim 9, wherein:

said control circuit of said detecting circuit comprises a comparator having an input connected to said receiver;

said thread recognition circuit of said detecting circuit comprising:

a first comparator having an input connected to said input of said comparator of said control circuit;

an integrator series connected to said first comparator; and a second comparator series connected to said integrator and having an output;

said output of said second comparator being connected to said monitoring and control circuit in order to positively differentiate between true thread signals and defective thread signals.

12. The apparatus as defined in claim 10, wherein:

said operatively connected means comprise a pulse generator controlled by the weaving machine;

said transmitter and said receiver constituting part of said control circuit;

said control circuit further comprising:

an amplitude-controlled oscillator operatively connected to said transmitter and having an input;

a selective filter, a rectifier, and a smoothing member series connected to each other and to said receiver;

a reference voltage generator generating a substantially constant reference voltage; and a comparator having two inputs and an output, a first of which inputs is connected to said smoothing member and a second of which inputs is connected to said reference voltage generator;

said controllable control member comprising a sample-and-hold member having two inputs and an output;

a first one of said two inputs of said sample-and-hold member being connected to said output of said comparator and a second one of said two inputs being connected to said pulse generator; and said output of said sample-and-hold member being connected to said input of said amplitude-controlled oscillator.

13. The apparatus as defined in claim 10, wherein:

said operatively connected means comprise a pulse generator controlled by the weaving machine;

said transmitter and said receiver constituting part of said control circuit;

said control circuit further comprising:

an oscillator operatively conneted to said transmitter;

a selective amplifier, a rectifier and a smoothing member series connected to each other and to said receiver;

said selective amplifier having two inputs;

a reference voltage generator generating a substantially constant reference voltage;

a comparator having two inputs and an output, a first of which inputs is connected to said smoothing member and a second of which inputs is connected to said reference voltage generator;

said controllable control member comprising a sample-and-hold member having two inputs and an output;

a first one of said two inputs of said sample-and-hold member being connected to said output of said comparator and a second one of said two inputs being connected to said pulse generator; and a first one of said two inputs of said selective amplifier being connected to said receiver and a second one of said two inputs being connected to said output of said sample-and-hold member.

14. The apparatus as defined in claim 10, wherein:

said means operatively connected to the weaving machine defines a control interval and a monitoring interval;

said operatively connected means comprising a pulse generator controlled by said weaving machine; and said pulse generator supplying at least one pulse for defining said control interval for controlling the weaving machine and said monitoring interval for thread recognition.

15. The apparatus as defined in claim 14, wherein:

said pulse generator controlled by said weaving machine generates at least one pulse determining said control interval and a monitoring interval coinciding therewith.

16. The apparatus as defined in claim 14, wherein:

said pulse generator controlled by said weaving machine generates at least one pulse determining said control interval; and additional switching means for defining a monitoring interval forming a subinterval of said control interval.

17. The apparatus as defined in claim 16, wherein:

each said pulse comprises a leading edge and a trailing edge; and each said leading edge and trailing edge being employed to trigger switching functions.

18. The apparatus as defined in claim 16, wherein:

said pulse generator supplies two pulses each of which is utilized to trigger switching functions.

19. The apparatus as defined in claim 10, wherein:

said operatively connected means comprise a pulse generator controlled by the weaving machine;

said transmitter and said reciever constituting part of said control circuit;

said control circuit further comprising:

a reference voltage generator generating a substantially constant reference voltage; and a comparator having two inputs, a first of which is connected to said receiver and a second of which is connected to said reference voltage generator;

said comparator having an output connected to a first input of said controllable control member;

said controllable control member having a second input operatively connected to said pulse generator; and said controllable control member having an output connected to said controllable current source supplying current to said transmitter.

20. The apparatus as defined in claim 11, wherein:

said controllable control member comprises a sample-and-hold member.

21. An apparatus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine in order to monitor and control the function thereof;

said detecting circuit comprising a sample-and-hold member having at least one input and further comprises a thread recognition circuit for recognizing a thread signal;

said monitoring and control circuit comprising:

a pulse generator controlled by the weaving machine;

a clock pulse generator connected at an input side thereof to said pulse generator and at an output side thereof to said at least one input of said sample-and-hold member;

said clock pulse generator being feed-back connected to define the start of a monitoring interval;

a counting pulse unit for generating a sequence of counting pulses and having an output;

said counting pulse unit being controlled by said clock pulse generator;

a control unit controlled by said clock pulse generator; and a counting and indicating unit connected to said clock pulse generator and to said thread recognition circuit;

said counting and indicating unit indicating coincidence of one of said counting pulses in said sequence of counting pulses and said thread signal; and a malfunction and the nature of such malfunction of the weaving machine being indicated by a change in the position in the sequence of said counting pulse coinciding with said thread signal.

22. The apparatus as defined in claim 21, wherein:

said feed-back connected clock pulse generator of said monitoring and control circuit comprises:

a first AND-gate having a first input, a second input and an output, the first input of which is connected to said pulse generator;

an adjustable monostable multivibrator connected to said output of said first AND-gate;

a first monostable multivibrator having a first input, a second input connected to said adjustable monostable multivibrator, and an output connected to said at least one input of said sample-and-hold member;

a second AND-gate having two inputs and an output, the first input of said second AND-gate being connected to said adjustable monostable multivibrator and the second input being connected to said output of said first monostable multivibrator;

a third AND-gate having two inputs and an output, the first input of the third AND-gate being connected to said pulse generator and the second input being connected to said output of said second AND-gate and to the second input of said first AND-gate; and said output of said third AND-gate being connected to said first input of said first monostable multivibrator and to said control unit.

23. The apparatus as defined in claim 22, wherein:

said counting pulse unit in said monitoring and control circuit comprises:

a fourth AND-gate having two inputs and an output, the first input being connected to said output of said second AND-gate and the second input being connected to an output of said counting pulse unit to receive therefrom a pulse terminating said sequence of pulses; and a counting pulse generator having an input connected to said output of said fourth AND-gate and an output connected to said counting and indicating unit.

24. The apparatus as defined in claim 23, wherein:

said thread recognition circuit of said detecting circuit has an output; and said counting and indicating unit of said monitoring and control unit comprising:

a storage member having two inputs and an output, the first input being connected to said output of said thread recognition circuit and the second input being connected to said output of said first monostable multivibrator in said feed-back connected clock pulse generator;

an indicator controlled by said storage member;

a counter controlled by said storage member and connected parallel to said indicator;

said counter having a first input connected to said indicator, a second input connected to said output of said first AND-gate in said feed-back connected clock pulse generator, a third input connected to said counting pulse generator in said counting pulse unit, a fourth input connected to said storage member and an output connected to said second input of said fourth AND-gate in said counting pulse unit and to said control unit.

25. The apparatus as defined in claim 24, further including:

a relay provided for the weaving machine; and said control unit of said monitoring and control circuit comprising:

a second monostable multivibrator connected to said relay; and a fifth AND-gate having two inputs and an output, a first input being connected to said output of said counter in said counting and indicating unit, a second input being connected to said output of said third AND-gate in said feed-back connected clock pulse generator, and the output of said fifth AND-gate controlling said second monostable multivibrator.

26. An apparatus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine in order to monitor and control the function thereof;

said detecting circuit comprises a sample-and-hold member having at least one input and further comprises a thread recognition circuit for recognizing a thread signal; and said monitoring and control circuit comprising:

a pulse generator controlled by the weaving machine;

said pulse generator being connected to said at least one input of said sample-and-hold member;

an inverter connected to said pulse generator;

a storage member supplied with pulses by said thread recognition circuit of said detecting circuit; and a control unit connected to said inverter and to said storage member for controlling the weaving machine in correspondence with said thread signal.

27. The apparatus as defined in claim 22, further including:

a relay provided for the weaving machine; and said control unit of said monitoring and control circuit comprising:

a dynamic monostable multivibrator controlling said relay; and a fifth AND-gate having two inputs and an output, a first input being connected to said storage member, a second input being connected to said inverter and the output controlling said dynamic monostable multivibrator.

28. An appartus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine or order to monitor and control the function thereof;

said detecting circuit comprises a sample-and-hold member having at least one input and further comprises a thread recognition circuit for recognizing a thread signal; and said monitoring and control circuit comprising:

a pulse generator controlled by the weaving machine;

said pulse generator being connected to said at least one input of said sample-and-hold member;

a control unit connected to said pulse generator;

a storage member having two inputs and an output; and a first one of said tow inputs of said storage member being connected to said pulse generator, a second one of said two inputs being connected to said thread recognition circuit and said output being connected to said control unit.

29. The apparatus as defined in claim 23, further including:

a relay provided for the weaving machine;

said control unit of said monitoring and control circuit comprising:

a second monostable multivibrator controlling said relay; and a dynamic AND-gate having two inputs and an output, a first input being connected to said storage member, a second input being connected to said pulse generator and the output being connected to said second monostable multivibrator.

30. An apparatus for monitoring a weft thread in a weaving machine operated in operating cycles, comprising:

a sensing head for sensing a weft thread;

said sensing head comprising a transmitter and a receiver;

a signal processing and evaluating circuit operatively connected to said sensing head;

said signal processing and evaluating circuit comprising:

a detecting circuit for deriving a thread signal which is independent of extraneous effects;

a monitoring and control circuit operatively connected to said detecting circuit for linking said thread signal to operating cycles of the weaving machine in order to monitor and control the function thereof; and at least one microprocessor for effectuating switching functions of said circuits.

* * * * *